United States Patent [19]

Norlander

[11] 4,252,164

[45] Feb. 24, 1981

[54] ATTACHMENT FOR ROUTER

[76] Inventor: Warren Norlander, Dresser, Wis. 54009

[21] Appl. No.: 89,049

[22] Filed: Oct. 29, 1979

[51] Int. Cl.[3] ..... B27C 5/00

[52] U.S. Cl. ..... 144/134 D; 409/182

[58] Field of Search ..... 409/175, 182; 33/27 R, 33/27 E, 41 E, 41 F; 144/134 R, 134 D, 136 R, 136 D, 323

[56] References Cited

U.S. PATENT DOCUMENTS

| | | | |
|---|---|---|---|
| 2,587,994 | 3/1952 | Gregory | 144/134 D |
| 2,729,437 | 1/1956 | Brenner | 144/136 C |
| 4,044,805 | 8/1977 | Gronholz | 144/134 D |
| 4,174,746 | 11/1979 | Walker et al. | 144/134 R |

*Primary Examiner*—W. Donald Bray

[57] ABSTRACT

An attachment for power tool such as a router adapted to cut an end of circular cross-section onto a rectangular piece of wood suitable for use as a circular tenon in mortise and tenon construction, the attachment being formed from a block of solid material adapted to be attached to the power tool adjacent the cutting element thereof, said block of solid material having a recess therein with a solid pointed metal element such as a drill bit centered in said recession, attached to the bottom thereof and protruding therefrom to form a point upon which the wood to be cut can be rotated, there being a groove or cut-away portion in said block adjacent and extending into a side of said recession to receive the cutting element of the tool.

3 Claims, 5 Drawing Figures

ATTACHMENT FOR ROUTER

BACKGROUND OF THE INVENTION

This invention relates to an attachment for a power tool, especially a router, adapted to facilitate material working, shaping or operations, such as woodworking, and to particularly make possible the easy cutting of an end of circular cross-section on a piece of rectangular cross-section wood. Such cutting is often necessary, for example, in formation of cross or brace pieces between the legs of furniture in which a round end or tenon is tightly fitted and glued into a circular indentation or mortise in the leg of the furniture such as a chair.

Wood molding and forming operations, such as required to construct bracing members between chair legs, frequently are performed manually by skilled craftsmen. Such operations are time consuming and thus limit production output and increase the cost of articles being produced.

The present invention provides an attachment for a power tool such as an electric router which facilitates the cutting of round ends on pieces of wood of rectangular or other noncircular cross-sections. Similar operations can be conducted on articles made from other materials such as plastics using the attachment of the present invention. Circular cross-section or sculptured pieces can also be worked on with the use of the invention to provide such items with circular cross-section ends of reduced diameter. The invention provides a simple attachment for such a power tool against which the end of the piece of wood or other material to be cut can be centered and rotated by hand as the cutting element of the power tool cuts away the wood to the desired depth in a circular cross-section. The device of the present invention is easily attached or detached from the power tool which is then available for use in other cutting operations as desired.

The attachment of this invention is adapted specifically to be used with an electric router but can be adapted for use in conjunction with other rotary power tools such as an electric drill in which a cutting tool is installed.

Summarized briefly, the attachment of the present invention formed from a block of solid material adapted to be attached to the power tool adjacent the cutting element thereof, said block of solid material having a recess therein with a solid pointed metal element such as a drill bit centered in said recession, attached to the bottom thereof and protruding therefrom to form a point upon which the wood to be cut can be rotated, there being a groove or cut-away portion in said block adjacent and extending into a side of said recession to receive the cutting element of the tool.

The attachment includes the following elements: a block of rigid material, usually metal, provided with means such as threaded, tapped holes to attach the same to a router or similar power tool adjacent the cutting element thereof; the block having a recess therein, preferrably of circular cross-section; there being a thin solid metal element such as a drill bit of circular cross-section centered in said recess and attached to the bottom thereof, which element protrudes above the surface of the block to form a point upon which the wood to be cut can be rotated, and a groove or cut-away portion in said block adjacent and extending into a side of said recess to receive the cutting element of the tool.

The invention will be set forth more particularly in the following description and accompanying drawings, in which:

FIG. 4 is a fragmentary cross-sectional view taken along line 4—4 of FIG. 2 view showing the attachment of the present invention in cross-section together with a fragmentary view of the router bit and piece of wood being worked on;

DESCRIPTION OF THE PREFERRED EMBODIMENT

Figure 1:
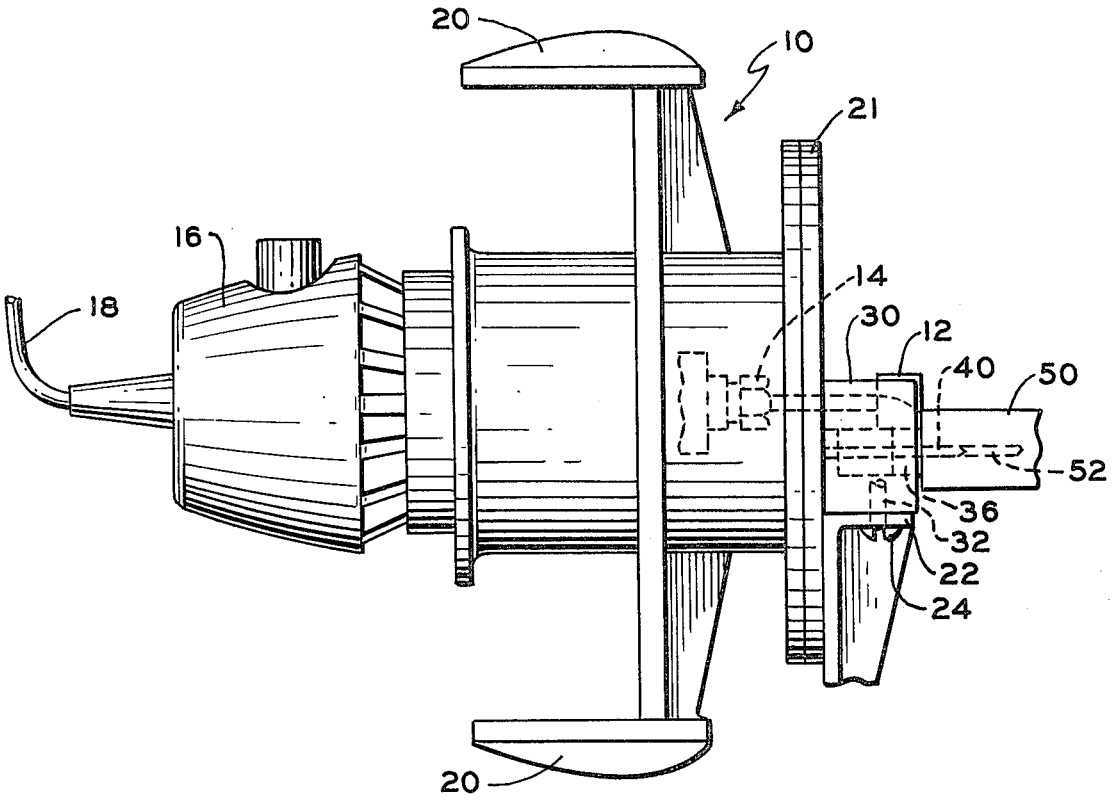
FIG. 1 is a side view of an electric power router on which an attachment of the present invention is installed.

Referring more particluarly to the drawings, there is seen in FIG. 1 an electric router 10 of conventional design which is readily available at hardware stores or similar retail outlets. Router 10 is equipped with a cutting tool 12, which is mounted in chuck 14 of the router in conventional fashion. Numerous types of cutting elements are commercially available, the one shown for purposes of illustration being a rabbet type, although a straight fluted cutting element suitable for general purpose cutting can readily be used. Other elements of router 10 include an electric motor portion 16, electric cord 18, handles 20 and sole plate 21, all of which are of standard design and therefore will not be described in detail herein.

An adjustable work contacting guide 22 is typically either provided with a commercially obtainable router or is available as an attachment. Such guide is used as a means to hold the attachment of the present invention in position on the router. Guide 22 provides a means for adjustably positioning the attachment of the invention adjacent the cutting blade of the router so that the atttachment can work in conjunction therewith to cut circular cross-sections in wood of different diameters. The attachment of this invention generally indicated by numeral 30 is attached to guide 22 by means of screws 24 which are threaded into tapped holes 32. Guide 22 is conventionally provided with appropriate holes or slots through which screws 24 can be inserted. Attachment 30 is provided with a cut-away portion 34 best observed in FIG. 2 and FIG. 3. Cut-away portion 34, while illustrated as being of semi-circular configuration can be of elliptical, rectangular or other cross-section so long as it accommodates cutting tool 12. It will be noted that the central axis of the cut-away portion is aligned parallel to that of the cutting tool so that the latter can be raised and lowered therein. Interconnected with cut-away portion 34 is a circular recess 36 which is provided with a base portion 38 normally of a flat circular configuration which is preferably normal to the access of the recess. Attached to the center of the base and protruding upwardly along the access of the recess is a thin metal peg or shaft 40. Conveniently, shaft 40 may be simply a metallic drill bit which is attached to the base by means of a set-screw 42. As noted, the shaft 40 extends above the surface of attachment 30.

Attachment 30 is conveniently formed from a solid block of metal into which the circular recession 36 is countersunk normal to the top surface thereof and parallel with cut-away portion 34.

Figure 2:
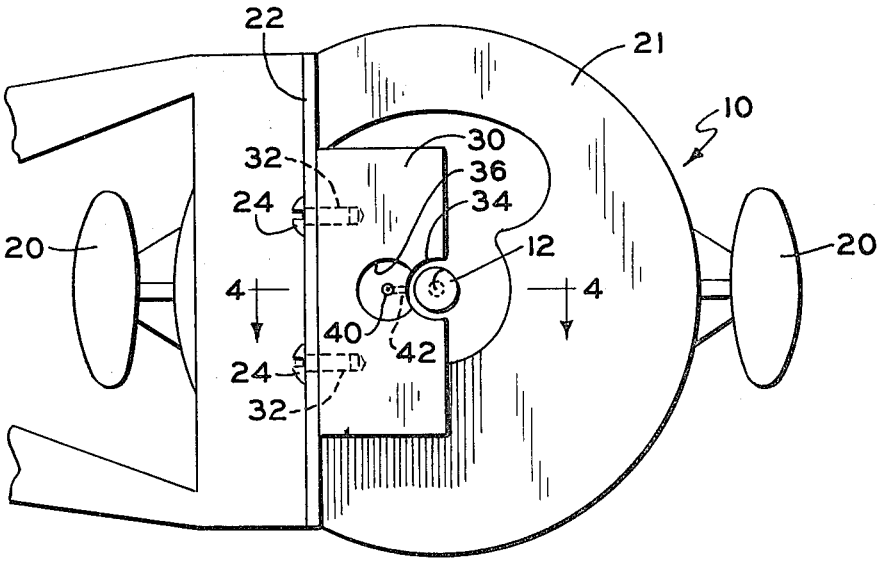
FIG. 2 is an end view of the router in an attachment shown in FIG. 1.
Figure 3:
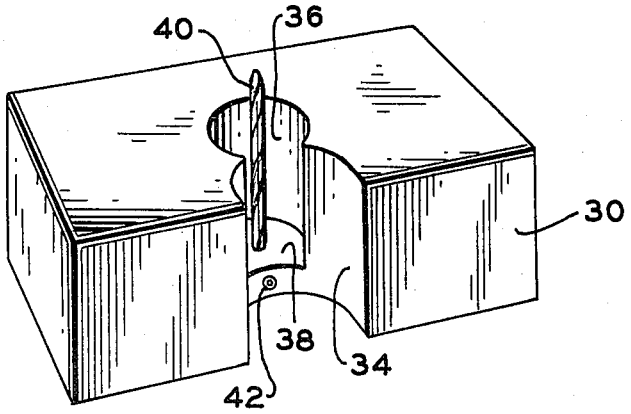
FIG. 3 is a perspective view of an attachment of the present invention.
Figure 4:
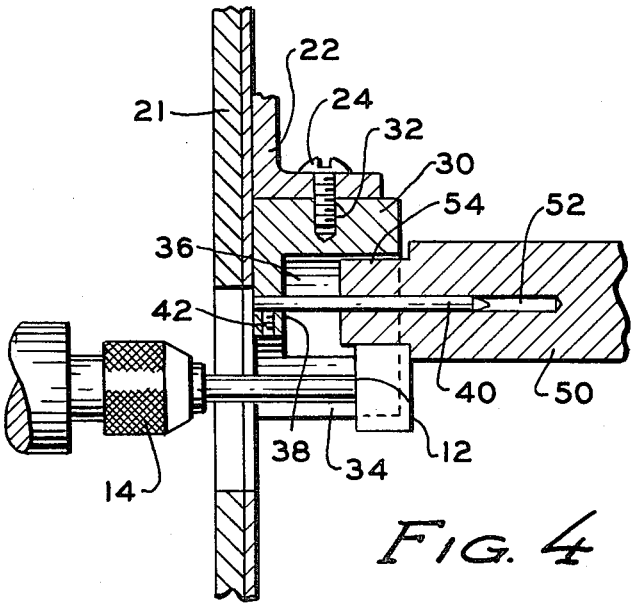
Figure 5:
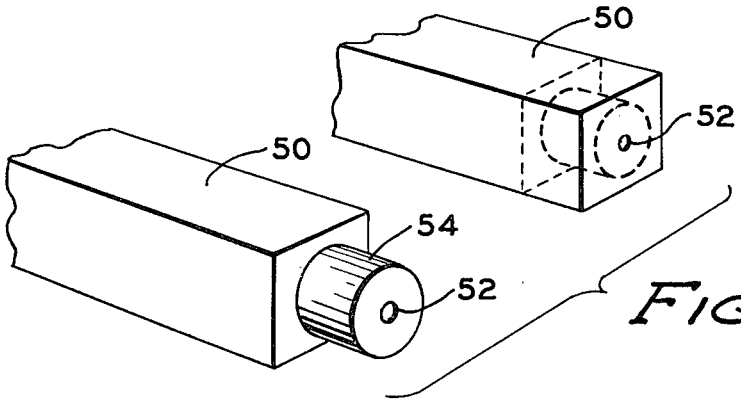
FIG. 5 is a fragmentary view of a piece of wood cut in accordance with the present invention illustrating the same to be predrilled in the center.

FIG. 4 illustrates a piece of wood which can conveniently be worked on using the attachment of this invention. Block of wood 50 is usually of a square cross-section. It is provided with a predrilled hole 52 of a diameter sufficient to slide over shaft 40. In operation, block of wood 50 is placed over shaft 40 of an attachment of this invention in position on a router. Router bit 12 is placed at the desired location to provide a round end 54 of the desired dimension. To use the attachment, the same is mounted on the router as shown in FIG. 2 and FIG. 4. The router bit is placed in rotation and piece of wood 50 is manually placed over shaft 40 and manually rotated so that the router blade will cut-away the end of wood 50 so as to form a figuration as shown in the lower portion of FIG. 5. Circular end 54 is suitable for use as a tenon of circular cross-section conveniently used for mortise and tenon construction.

It will be noted that attachment 30 can readily be removed from the router by extracting screws 24. The router can then quickly be converted for use in other operations. The structure of the present invention is simple and economical to fabricate yet provides a construction which is rugged and fool-proof and gives greatly added versatility to a conventional router. The attachment can be adapted for use with a simple electric drill also by attaching an appropriate holding bracket thereto to position the attachment adjacent the tool portion of the drill. The drill would have to be fitted with an appropriate cutting end suitable to cut a circular tenon on the end of a piece of wood.

It will be apparent to those skilled in the art that many further modifications and changes can be made in the construction of the attachment shown in the drawings. For example, the same could be partially hollowed out to save weight and cost of material. The means for attaching can be modified, for example, by providing a projecting threaded end as an integral part of block or by substituting other similar mechanical devices for attaching the same. Many other modifications within the scope of the invention will be apparent to those skilled in the art.

What is claimed is:

1. An attachment for power tool such as a router adapted to enable said tool to cut an end of circular cross-section onto a rectangular piece of wood comprising, (a) a block of rigid material provided with means attachable to a power tool adjacent the cutting element thereof, (b) said block having a recess therein, (c) there being a thin solid metal element of circular cross-section centered in said recess and attached to the bottom thereof, said element protruding above the surface of said block to form a point upon which the wood to be cut can be rotated, there being a groove or cut-away portion in said block adjacent and extending into a side of said recess to receive the cutting element of the tool.

2. An attachment for an electric router adapted to enable cutting by said tool of an end of circular cross-section onto a circular piece of wood, comprising, (a) a metal block provided with a cylindrically shaped recess therein, said recess having a flat circular base portion normal to the axis of said recess, (b) said block being provided with means for attaching the same to the adjustable guide means on a router, (c) said block having a cut-away portion adapted to receive the cutting element of the router extending through the thickness thereof, the central axis of said cut-away portion being parallel to the axis of said recess, said recess and said cut-away portion being peripherally interconnected, (d) a thin elongated metal shaft attached to the base of said recess and extending along the axis thereof to a point above the surface of said block.

3. Attachment according to claim 2 wherein said block is a solid metal block containing said recess and said cut-away portion and wherein said attaching means are threaded holes on one side of said block.

* * * * *